United States Patent [19]

Meckler

[11] 4,182,458

[45] Jan. 8, 1980

[54] WINE BOTTLE STOPPER

[76] Inventor: Milton Meckler, 16348 Tupper St., Sepulveda, Calif. 91343

[21] Appl. No.: 885,866

[22] Filed: Mar. 13, 1978

[51] Int. Cl.[2] ..... B65D 51/16

[52] U.S. Cl. ..... 215/307; 215/296; 215/297; 215/364

[58] Field of Search ..... 215/307, 296, 297, 355, 215/362, 364

[56] References Cited

U.S. PATENT DOCUMENTS

| | | | |
|---|---|---|---|
| 155,833 | 10/1874 | Hawkins | 215/364 |
| 332,382 | 12/1885 | Clough | 215/364 |
| 342,519 | 5/1886 | Korthaus | 215/362 |
| 378,907 | 3/1888 | Stepp | 215/297 |
| 523,474 | 7/1894 | Kalling | 215/364 |
| 533,412 | 1/1895 | Coon | 215/364 |
| 537,979 | 4/1895 | Kalling | 215/364 |
| 563,132 | 6/1896 | Brown | 215/364 |
| 1,314,848 | 9/1919 | Bars | 215/364 |

FOREIGN PATENT DOCUMENTS

| | | | |
|---|---|---|---|
| 26414 | 12/1923 | France | 215/307 |

*Primary Examiner*—Ro E. Hart

*Attorney, Agent, or Firm*—William H. Maxwell

[57] ABSTRACT

A stopper for wine bottles wherein a right cylinder cork member is retractably retained as a closure in the neck of the bottle by means of a plastic crown member with a vented head and with anchor legs isolated from the liquid wine contents of said bottle, the two members being assembled as a unit with a retainer ring.

17 Claims, 13 Drawing Figures

WINE BOTTLE STOPPER

BACKGROUND

Wine making has employed the stoppering of glass bottles since late 18th century (1790) substantially without change. The wine grape, *Vitus unifera,* has been processed in various ways to produce wines that have been bottled and closed therein with now the traditional "cork" stopper, and for very good reason. The cork stopper plays a major roll in wine making, as it is properly cut into shapes appropriate to the necks of different wine bottles, and permits only a miniscule amount of air to enter the bottle, "breathing" allowing the wine to age slowly to perfection. Without the cork, kept constantly moistened by the wine itself in the tilted bottle, air would swiftly turn the liquid to vinegar. Therefore, it is a general object of this invention to provide an improved wine bottle stopper that is conducive to the use of traditional cork and its inherent ability to provide for said miniscule amount of breathing.

The cork used for stopping wine bottles is from the cork oak, *Quercus suber* of Portugal, the only cork trees which contain bark of sufficient quality and thickness to warrant such use. Although the cork supply is treated with respect, it is difficult to maintain the quality thereof while meeting the increasing demand. Therefore, it is an object of this invention to use less cork in stoppering the bottles, and a system of stoppering adaptable to cork of less durable quality.

The advent of plastics has not been conducive to the stoppering of wine bottles, for those reasons advanced above with respect to miniscule breathing, and also for the reason that plastics tend to chemically contaminate the liquid wine giving it a distressing taste. On the contrary, the natural bark cork is compatible with wine making processes, and particularly the aging of wine in the bottle, and to this end is highly desirable as a stopper. However, wet and aged cork stoppers tend to disintegrate and they are often difficult to remove from the bottle necks. Accordingly, it is an object of this invention to provide a combined cork and plastic stopper, the cork employed for its traditional advantages and the plastic employed for its superior structural integrity. With the present invention, the plastic member reinforces the cork and all of which is arranged for ease of both installation and extraction.

Stoppering of wine bottles is accomplished by both manual and automated pressing of the corks into the bottle necks, it being an object of this invention to provide a unit combined of the aforesaid cork and crown members which is also conducive to either manual or automated installation into the bottle neck. With the present invention, a retaining ring is included in the combination in order to constrain the legs of the crown member to the mean inner diameter of the bottle neck, whereby insertion is facilitated.

Re-stoppering of wine has not been too satisfactory when reusing the original cork stopper, simply because the usual mode of removal employs a "corkscrew" that penetrates the cork and destroys its integrity or sealing capability. That is, the penetrated cork no longer has miniscule control over the entry of air. Furthermore, the use of corkscrews results in crumbs of cork dropping into the liquid wine, it being customary and the duty of the host to dispose of the first wine poured from the bottle which contains these crumbs of cork etc. It is an object therefore, to provide a stopper head that is engageable by various means, without penetration of the cork, without crumbling the same, and to remove the stopper combination from the bottle neck; either manually or with the aid of a conventional corkscrew or special mechanical puller. With the present invention there is a plastic member that establishes a head which overlies the cork member, and which is vented for said miniscule breathing; and there are anchors depending from the head to engage between the bottle neck and cork and by which the cork is gripped for subsequent extraction. The head of the plastic member supplies the structural integrity for extraction, through mechanical engagement with the corkscrew and/or the special puller, and all to the end that the cork is not penetrated. Re-insertion of this stopper combination is then effective in re-establishing the original stopped condition.

SUMMARY OF THE INVENTION

This invention relates to the aging of and merchandising of wine in bottles, providing the stoppering thereof by means of cork. The wine bottle stopper as it is herein disclosed in comprised of two members, the primary cork seal A and the secondary crown B for installation, protection and removal of the cork seal A. And for unit preparation the combination includes a retainer ring R. In each of its various forms disclosed herein, the cork seal member A is a right cylinder (see FIGS. 2 and 11) that enters the neck of the bottle in the usual manner, and the structural crown member B is of plastic or the like and comprised of a head 10 vented at 11 and depending legs 12 that embrace and have anchored engagement with the cork seal member A. The cork seal member A is a compressible cork fiber characterized by its capability of miniscule breathing, made oversized with respect to the inner diameter of the bottle neck. The structural crown member B is of rigid plastic characterized by its relative stiffness, flexibility and hardness substantially less than the glass of the bottle and substantially greater than the fiber of the cork. A feature of the present invention is that in no instance does the liquid wine pass the cork seal member A, and in no case does said liquid wine come into contact with the structural crown member B. This latter feature ensures that the liquid wine cannot be tainted by the plastic material of member B.

DRAWINGS

The various objects and features of this invention will be fully understood from the following detailed description of the typical preferred forms and applications thereof, throughout which description reference is made to the accompanying drawings in which.

Figure 7:
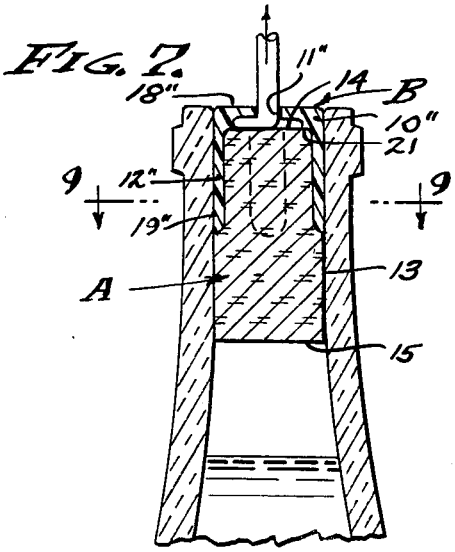
FIGS. 7 to 9 illustrate a third embodiment of the present invention, FIG. 7 being a view similar to FIG. 1, FIG. 8 being a perspective view of the crown member of the combination, and FIG. 9 being an enlarged sectional view taken as indicated by line 9—9 on FIG. 7.
Figure 8:
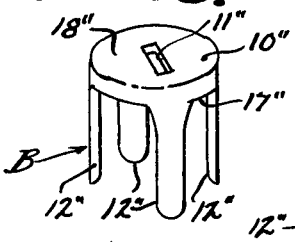
Figure 9:
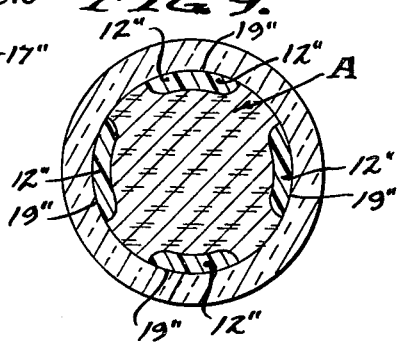
Figure 10:
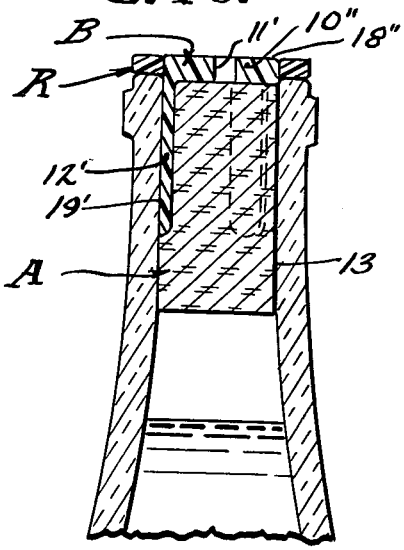
Figure 11:
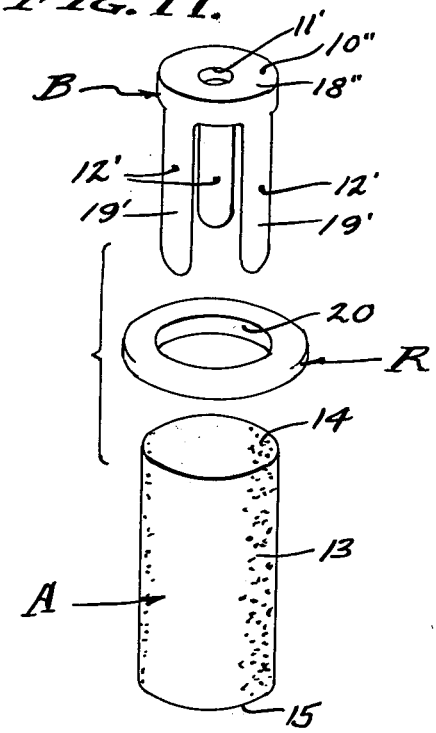
Figure 12:
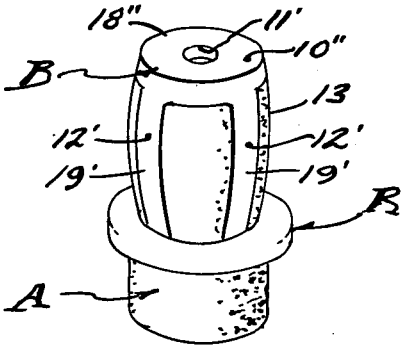
Figure 13:
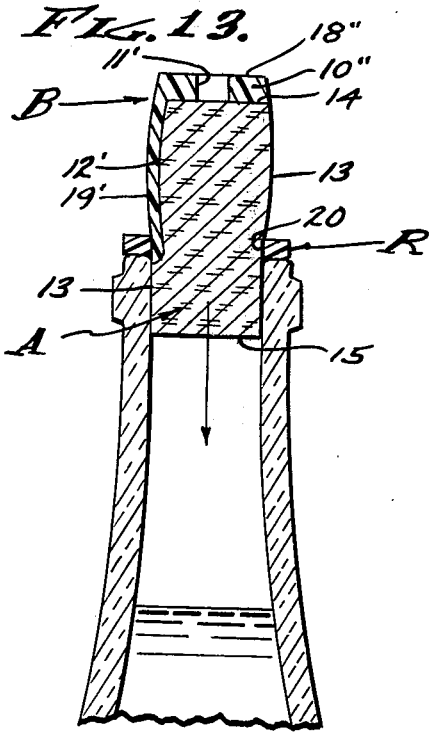

FIGS. 10 to 13 illustrate the unit adaptation of the embodiment shown in FIGS. 7 to 9 and includes therewith a retaining ring R, FIG. 10 being a view similar to FIG. 7, FIG. 11 being an exploded perspective view of the three members of the unit assembly, FIG. 12 being a perspective view of said unit assembly, and FIG. 13 being a view similar to FIG. 10 and showing the process of starting the stopper unit into a bottle neck.

PREFERRED EMBODIMENT

Referring now to the drawings, there are four embodiments of this invention shown therein, all of which include generally the primary cork seal member A and the secondary crown member B. The cork member A remains the same in each embodiment, while the crown member B varies in the head and anchor legs thereof. In each instance the two members A and B are combined in the same identical manner, the latter embracing the former and both frictionally entered into the inner diameter of the bottle neck, as shown.

The primary cork seal member A is in the form of a fibrous solid of cork, the bark of the cork oak *Quercus suber*, of elongated right cylinder form and substantially larger in diameter than the inside diameter of the bottle neck into which it is pressed. As shown, the cork member A has a uniform outside diameter 13 and normal ends 14 and 15. It is the lower margin of the diameter 13, or which ever end is lowermost, that seals with the inner diameter wall of the bottle neck. The said inner diameter of the bottle neck is substantially cylindrical, of uniform diameter, but in some instances slightly tapered. However, any slight amount of taper has little or no effect on the frictional anchorage of this combination stopper.

The secondary crown member B is in the form of an injection molded plastic body comprised of the head 10 and at least a pair of legs 12. The plastic body can be molded of any rigid plastic, such as polystyrene or the like, characterized by the relative stiffness and flexibility of the thin elongated leg members thereof. The head 10 overlies the top end 14 of the cork member A while the legs 12 are integral therewith and disposed so as to embrace the upper margin of the cork diameter within the confines of the bottle neck. As shown throughout the drawings, the vent 11 opens through the head 10 to expose the upper end of the cork member A to atmosphere.

Figure 1:
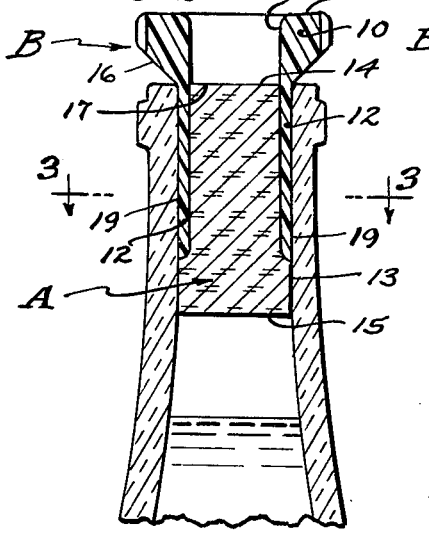
FIGS. 1 to 3 illustrate a first embodiment of the present invention, FIG. 1 being a sectional view through a bottle neck with the stopper installed therein, FIG. 2 being an exploded perspective view of the two members comprising the stopper combination, and FIG. 3 being an enlarged sectional view taken as indicated by line 3—3 on FIG. 1.
Figure 2:
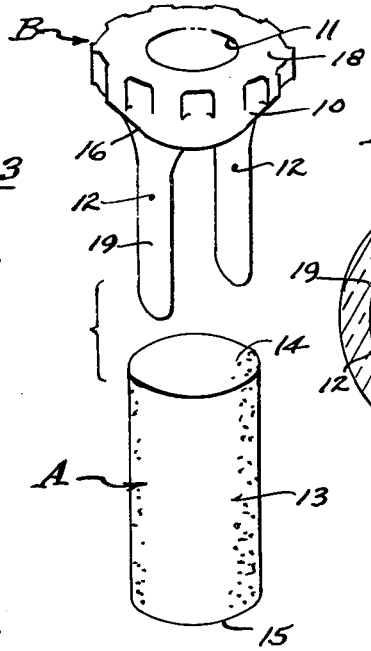
Figure 3:
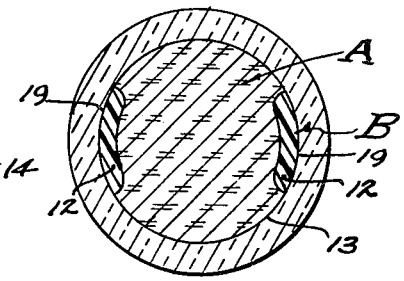

Referring now to the first embodiment shown in FIGS. 1 to 3, the head 10 is a circular part that also overlies the top of the bottle neck. The head 10 is of substantial size or heft and thereby conducive to being gripped by the fingers of a person for upward turning and pulling force applied in removal. Accordingly, said grip is afforded by its upwardly and outwardly flared side 16 extending from its bottom 17 and terminating at the top side 18, at or within the outside bottle neck diameter. The vent diameter is slightly less than the inside bottle neck diameter, as it is determined by and continues from the inner faces of the legs 12 next to be described. Consequently, in this embodiment substantially the entire end 14 of the cork member A is exposed to atmosphere.

In accordance with this first embodiment of the invention, the legs 12 depend integrally from the bottom 17 of the head 10 between the hardness of the glass bottle neck and the softness of the cork member exterior diameter 13. The two legs 12 of this first embodiment are disposed 180° apart with their outer sides 19 substantially coincidental with the inner diameter of the bottle neck. That is, the sides 19 of the legs are arcuately formed to the inner diameter wall of the bottle neck. In practice, the legs are relatively thin parts that are arcuately flattened in circumferential cross section, and they extend downward to embrace a substantial margin of the cork member A, preferably one half to three quarters the height of the cork member A. The legs 12 are depressed into the exterior diameter 13 of the cork member to frictionally engage therewith, the coefficient of friction being substantially greater with the cork member than with the surrounding glass wall of the bottle neck.

Figure 4:
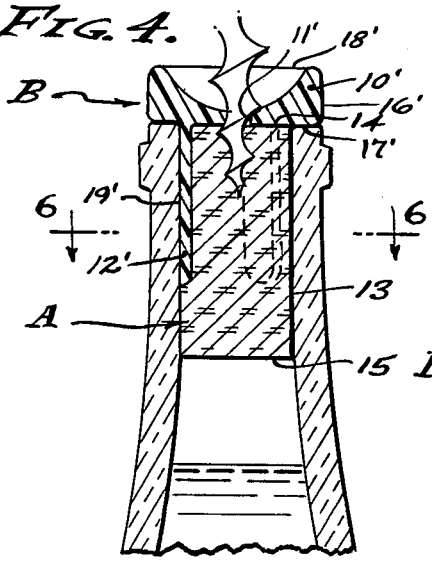
FIGS. 4 to 6 illustrate a second embodiment of the present invention, FIG. 4 being a view similar to FIG. 1, FIG. 5 being a perspective view of the crown member of the combination, and FIG. 6 being an enlarged sectional view taken as indicated by line 6—6 on FIG. 4.
Figure 5:
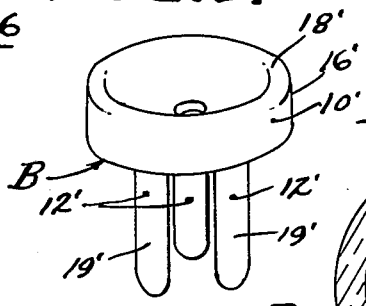
Figure 6:
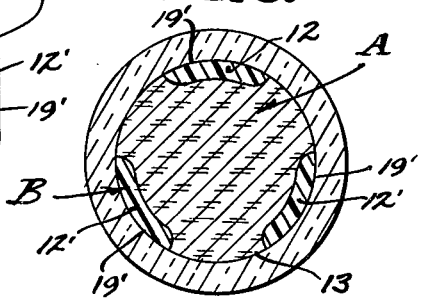

Referring now to the second embodiment shown in FIGS. 4 to 6, the head 10' is a disc-shaped part that overlies both the end 14 of the cork member A and the top of the bottle neck. The head 10' is of substantial thickness and strength and thereby conducive to being engaged by a classic corkscrew as shown in FIG. 4, for the application of upward turning and pulling force for removal. In this embodiment the head 10' has a flanged perimeter coextensively overlying the top of the bottle neck, which is aslo adapted to being gripped by the fingers of a person for upward pulling and twisting force applied for removal. Accordingly, said grip is afforded by its extended bottom 17' and cylindrical side wall 16' extending upwardly to the top 18'. In practice, the top 18' is concaved in order to reduce wall thickness while providing a substantial gripping height. The vent 11' is here a hole or port centered over the top 14 of the cork member A exposing it to atmosphere.

In accordance with this second embodiment of the invention the legs 12' depend integrally from the bottom 17' of the head 10' between the glass bottle neck and upper margin of the cork member A. In this embodiment there are three legs 12' disposed 120° apart with their outer sides 19' substantially coincidental with the inner diameter wall of the bottle neck. The legs 12' are formed the same as the above described legs 12, and they extend downward to embrace a substantial margin of the cork member A.

Referring now to the third embodiment shown in FIGS. 7 to 9, the head 10'' is a disc-shaped part that overlies the end of the cork member A and adapted to be pressed flush therewith to the top of the bottle neck. The head 10'' is of substantial thickness and strength and thereby conducive to being engaged by a mechanical puller as shown in FIG. 7, for the application of upward turning and pulling force for removal. In this embodiment the head 10'' has a perimeter substantially coincidental with the inner diameter wall of the bottle neck, and the vent opening 11'' is slot-shaped in order to accept a key such as for example a hook-shaped puller as indicated in FIG. 7. In practice, the top 18'' is spaced from the top 14 of the cork member A by a shoulder 21, and which provides a space for the accommodation and turning of the key into a normal position in relation to the slot shaped vent 11'', for the application of withdrawal force. The slot-shaped vent 11'' exposes the member A to atmosphere.

In accordance with this third embodiment of the invention, the legs 12'' depend integrally from the bottom 17'' of the head 10'' between the glass bottle neck and upper margin of the cork member A. In this embodiment there are four legs 12'' disposed 90° apart with the outer sides 19'' substantially coincidental with the inner diameter wall of the bottle neck. The legs 12″ are formed the same as the above described legs 12, and they extend downward to embrace a substantial margin of the cork member A.

Referring now to the fourth embodiment shown in FIGS. 10 to 13, the crown member is essentially the same as the embodiment of FIG. 8 and having the legs and vent of FIG. 5. Accordingly, the head 10″ is a disc-shaped part that overlies the end of the cork member A and adapted to be pressed substantially flush therewith to the top of the bottle neck. The head 10″ has a perimeter substantially coincidental with the inner diameter wall of the bottle neck. The vent 11″ is here a large hole or port centered over the top 14 of the cork member A exposing it to atmosphere.

In accordance with this fourth embodiment of the invention the three legs 12′ depend as they are hereinabove described in the second embodiment of FIG. 5. As best illustrated in FIG. 12, the legs 12′ are contrained by the retainer ring R which slides over the outer sides 19′ of the legs burying or depressing them into the outer diameter 13 of the cork member A (see also FIG. 13). In practice, the inner diameter 20 of the ring R is press fit over the outer diameter 19′ of the legs to slide thereon between the positions shown in FIGS. 12 and 13, and engageable with the top of the bottle neck to do so, as indicated. Note particularly FIG. 11 of the drawing and the relative outside diameter of the cork member A and crown member B as related to the inner diameter of the retaining ring R. The assembled combination of FIG. 12 is inserted into the bottle neck as shown in FIG. 13 and subsequently pressed into the installed position shown in FIG. 10. It will be observed that the ring R retains the legs 12′ in a constricted position conducive to the entry into the bottle neck, said cork member bellying outward between the ring R and top 18″ of the crown member. Thus, as the cork and crown member assembly is pressed into position the legs 12′ are straightened inwardly to press into the outer diameter 13 of the cork member as shown in FIG. 10. It is to be understood that the retainer nut R is also to be combined with the first two crown member embodiments of FIGS. 2 and 5 respectively.

From the foregoing it will be seen that the members A, B and R of this stopper combination are easily manufactured, one as heretofore practiced in the art but shorter as may be permitted, and the other two by injection in solid molds without the complication of slides. The crown member B can be installed onto the cork member A before or after the latter is placed into the bottle neck; preferably before, in which case any divergence of the legs or disposition thereof at a diameter greater than the inner diameter wall of the bottle neck is adjusted by the flexibility in said plastic body of the member B. As shown in FIGS. 10 to 13 the retainer ring R is employed to reduce the diameter position of the legs for free entry into the bottle neck. A feature of the crown member B is the external smoothness of the legs 12, 12′ and 12″ and the conformity to the inner diameter wall contour of the bottle neck, while compressing the cork solid of the member A radially for anchor friction. This disturbes the circumference interface of the cork seal member A throughout its upper margin, while the lower margin remains undisturbed to function as a liquid seal. As a result, a reliable structural head is provided by the crown member B, by which the cork seal member A can be repeatedly removed from the bottle neck without penetration thereof that would destroy the miniscule control of air therethrough which is so important in the preservation of quality in the wine content.

Having described only typical preferred forms and applications of my invention, I do not wish to be limited or restricted to the specific details herein set forth, but wish to reserve to myself any modifications or variations they may appear to those skilled in the art as set forth within the limits of the following claims.

I claim:

1. A replaceable stopper for wine bottles and the like having a smooth cylindrical neck bore, and including in combination; a compressible cork member of elongated straight sided right cylinder form greater in diameter than the inner wall of the bottle neck bore to be stopped, and a crown member of substantially rigid material and comprised of an engageable head overlying the cork member and at least a pair of straight legs depending from the head to anchor the same to the cork member within the confines of the inner wall of the bottle neck, the said legs having smooth exterior surfaces slideably engaging the smooth cylindrical neck bore and terminating substantially short of the bottom of the cork member exposed to the interior of the bottle whereby the lower portion of the cork member is a continuous circumferential seal.

2. The replaceable stopper as set forth in claim 1, wherein the head of the crown member has a vent exposing the top of the cork member for miniscule breathing to atmosphere.

3. The replaceable stopper as set forth in claim 1, wherein the head of the crown member is penetratable by a puller to withdraw the said stopper combination from the bottle neck bore.

4. The replaceable stopper as set forth in claim 1, wherein the head of the crown member is open to a key means and puller engageable therewith to withdraw the said stopper combination from the bottle neck bore.

5. The replaceable stopper as set forth in claim 1, wherein the head of the crown member has a vent opening exposing the top of the cork member for miniscule breathing to atmosphere and for penetration of said head by a puller to withdraw the said stopper combination from the bottle neck bore.

6. The replaceable stopper as set forth in claim 1, wherein the head of the crown member has a slotted vent opening exposing the top of the cork member for miniscule breathing to atmosphere and for the reception of a hook-shaped puller to withdraw the said stopper combination from the bottle neck bore.

7. The replaceable stopper as set forth in claim 1, wherein the head of the crown member is ring shaped to overlie the top of the bottle neck and exposing the top of the cork member for miniscule breathing to atmosphere.

8. The replaceable stopper as set forth in claim 1, wherein the head of the crown member is disc-shaped to overlie the top of the cork member and with a vent therethrough for exposing the top of the cork member for miniscule breathing to atmosphere.

9. The replaceable stopper as set forth in claim 1, wherein the head of the crown member is of disc-shape to overlie the top of the cork member and flanged to overlie the top of the bottle neck and with a vent therethrough for exposing the top of the cork member for miniscule breathing to atmosphere.

10. The replaceable stopper as set forth in claim 1, wherein the legs of the crown member are of substantially uniform cross section and depressible into the cork member for frictional engagement therewith.

11. The replaceable stopper as set forth in claim 1, wherein the legs of the crown member have arcuate side walls slideably engageable with the inner wall of the bottle neck and are of substantially uniform cross section and depressible into the cork member for frictional engagement therewith.

12. A replaceable stopper unit for wine bottles and the like having a smooth cylindrical neck bore, and including in combination; a compressible cork member of elongated straight sided right cylinder form greater in diameter than the inner wall of the bottle neck bore to be stopped, a crown member of substantially rigid material and comprised of an engageable head overlying the cork member and at least a pair of straight legs depending from the head to anchor the same to the cork member within the confines of the inner wall of the bottle neck, the said legs having smooth exterior surfaces slideably engaging the smooth cylindrical neck bore and terminating substantially short of the bottom of the cork member exposed to the interior of the bottle whereby the lower portion of the cork member is a continuous circumferential seal, and a retainer ring slideable on the exterior of the legs to constrict them for entry into the bottle neck.

13. The replaceable stopper unit as set forth in claim 12, wherein the retainer ring is press fit onto the exterior of the legs to slide thereon and constrict said legs for entry into the bottle neck bore.

14. The replaceable stopper unit as set forth in claim 12, wherein the legs of the crown member are of substantially uniform cross section and depressible into the cork member by means of the retainer ring press fit thereon and constricting said legs for entry into the bottle neck bore.

15. The replaceable stopper unit as set forth in claim 12, wherein the legs of the crown member are embraced at their terminal ends by the retainer ring press fit thereon and constricting the legs for depression into the cork member and for entry into the bottle neck bore.

16. The replaceable stopper unit as set forth in claim 12, wherein the legs of the crown member are embraced at their terminal ends by the retainer ring press fit thereon and constricting the legs for depression into the cork member and for entry into the bottle neck bore and thereafter slideable along said legs to embrace the legs at the head of the crown member.

17. The replaceable stopper unit as set forth in claim 12, wherein the legs of the crown member are embraced at their terminal ends by the retainer ring press fit thereon and constricting the legs for depression into the cork member and for entry into the bottle neck bore and thereafter slideable along said legs to embrace the head of the crown member.

* * * * *